US006595002B2

(12) United States Patent
Weisenstein

(10) Patent No.: US 6,595,002 B2
(45) Date of Patent: Jul. 22, 2003

(54) VIBRATION REDUCTION IN A COMBUSTION CHAMBER

(75) Inventor: Wolfgang Weisenstein, Remetschwil (CH)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 10/132,152

(22) Filed: Apr. 26, 2002

(65) Prior Publication Data

US 2002/0162336 A1 Nov. 7, 2002

(30) Foreign Application Priority Data

May 1, 2001 (EP) ..... 01810429

(51) Int. Cl.[7] ..... F02C 7/24

(52) U.S. Cl. ..... 60/772; 60/776; 60/725; 431/1; 431/114

(58) Field of Search ..... 60/725, 776, 804, 60/39.37, 737, 772; 431/1, 114

(56) References Cited

U.S. PATENT DOCUMENTS

| | | | | |
|---|---|---|---|---|
| 5,983,643 A | * | 11/1999 | Kiesow | 60/746 |
| 6,202,401 B1 | | 3/2001 | Seume et al. | |
| 6,205,764 B1 | * | 3/2001 | Hermann et al. | 60/776 |
| 6,430,930 B1 | * | 8/2002 | Andersson | 60/725 |
| 2002/0157400 A1 | * | 10/2002 | Schulten et al. | 60/772 |

FOREIGN PATENT DOCUMENTS

| | | |
|---|---|---|
| DE | 19849300 A1 | 4/2000 |
| EP | 0962704 A2 | 12/1999 |
| WO | WO 93/10401 * | 5/1993 |

OTHER PUBLICATIONS

I. Veit, "Technische Akustik: Grundlagen der physikalischen, physiologischen und Elektroakustik", Vogel Verlag & Druck GmbH & Co. KG, 1974, pp. 5, 84–85.

* cited by examiner

*Primary Examiner*—Charles G. Freay
(74) *Attorney, Agent, or Firm*—Burns, Doane, Swecker & Mathis, L.L.P.

(57) ABSTRACT

A combustion chamber according to the invention has a number b0 of annularly arranged burners, of which a number k of modulatable burners have means for modulating a fuel mass flow, k being k<b0, and the modulatable burners being arranged in such a way that between every pair of adjacent modulatable burners are arranged in each case a1, a2, . . . ak nonmodulatable burners, and that the values a1+1, a2+1, . . . , ak+1 are not integral divisors of b0. In a preferred embodiment of the invention, a highest value of $$LCM(b0, a1+1), LCM(b0, a2+1), \ldots LCM(b0, ak+1)$$

is maximum, LCM designating the lowest common multiple. It thereby becomes possible to damp a maximum number of azimuthal vibration modes of the combustion chamber by means of a minimum number of modulatable burners. Each pair of modulatable burners gives rise to at least one undesirable vibration or instability which, however, is damped by the other modulatable burner or burners arranged according to the invention.

10 Claims, 2 Drawing Sheets

VIBRATION REDUCTION IN A COMBUSTION CHAMBER

FIELD OF THE INVENTION

The invention relates to the field of thermal turbomachines. It relates to a combustion chamber and to a method for the reduction of thermoacoustic vibrations in a combustion chamber according to the preambles of patent claims 1 and 9 respectively.

BACKGROUND OF THE INVENTION

In annular combustion chambers of turbomachines, under specific operating states selfexcited pressure vibrations are formed, which are caused by the influence on one another of thermoacoustic pressure pulsations and a local release of heat. Such a pressure vibration is designated as a selfexcited combustion chamber pulsation or as instability and presents a serious problem in modern industrial gas turbines since these use premixing combustion. In premixing combustion, a fuel and air are intermixed as homogeneously as possible before combustion and are ignited only after mixing. Combustion is to be as lean as possible, in order to reduce NOx emissions. However, this lean combustion also necessitates a low flame temperature and makes it difficult to stabilize the flame. This applies above all, but not only, to swirl-stabilized premixing burners. If a plurality of burners are arranged in an annular combustion chamber, azimuthal combustion pulsations may occur, that is to say those taking effect along the combustion chamber circumference. The pressure amplitudes resulting from these combustion pulsations may attain magnitudes which put the mechanical integrity of the machine at risk. This is undesirable, and attempts are made to prevent it by various measures.

A known method for suppressing thermoacoustic vibrations is to install what are known as Helmholtz resonators, as shown in "Technische Akustik" [Technical Acoustics"], Ivar Veit, Vogel Buchverlag, 1996, page 84. These Helmholtz resonators have the disadvantage, however, that they are designed only for a predetermined frequency, and that, when further pulsations with other frequencies occur, further resonators designed for these frequencies have to be installed.

SUMMARY OF THE INVENTION

The object of the invention, therefore, is to provide a combustion chamber and a method for the reduction of thermoacoustic vibrations in a combustion chamber of the type initially mentioned, which eliminates the disadvantages mentioned above.

This object is achieved by a combustion chamber and a method for the reduction of thermoacoustic vibrations in a combustion chamber, having the features of patent claims 1 and 9 respectively.

The combustion chamber according to the invention thus has a number b0 of annularly arranged burners, of which a number k of modulatable burners have means for modulating a fuel mass flow, k being k<b0, and the modulatable burners being arranged in such a way that between every two modulatable burners are arranged in each case a1, a2, . . . ak nonmodulatable burners, and that the values a1+1, a2+1, . . . , ak+1 are not integral divisors of b0.

It thereby becomes possible to damp a maximum number of azimuthal vibration modes by means of a minimum number of modulatable burners. It is not possible, in the present prior art, to foresee without any doubt the occurrence of an azimuthal combustion vibration during the design phase of the combustion chamber. Each pair of modulatable burners may therefore give rise to at least one undesirable vibration or instability which, however, is damped by the other modulatable burner or burners arranged according to the invention.

In a preferred embodiment of the subject of the invention, a highest value of $$LCM(b\mathbf{0}, a\mathbf{1}+1), LCM(b\mathbf{0}, a\mathbf{2}+1), \ldots LCM(b\mathbf{0}, ak+1)$$

is maximum, LCM designating the lowest common multiple.

In a further preferred embodiment of the subject of the invention, the number k of modulatable burners amounts to at least three.

In a further preferred embodiment of the subject of the invention, a1, a2, . . . ak are different from one another.

In a further preferred embodiment of the subject of the invention, the distances between modulatable burners between which exactly one modulatable burner is arranged are also taken into account: the modulatable burners are therefore arranged in such a way that a highest value of $$LCM(b\mathbf{0}, a\mathbf{1}+1), LCM(b\mathbf{0}, a\mathbf{2}+1), \ldots LCM(b\mathbf{0}, ak+1),$$
$$LCM(b\mathbf{0}, a\mathbf{1}+a\mathbf{2}+2), LCM(b\mathbf{0}, a\mathbf{2}+a\mathbf{3}+2), \ldots LCM(b\mathbf{0}, ak+a\mathbf{1}+2)$$

is maximum.

The advantage of these preferred embodiments is that they further increase characteristic frequencies of vibrations or modes which may still occur according to the arrangement of the modulatable burners.

In a further preferred embodiment of the invention, the modulatable burners are designed in such a way that they modulate their fuel mass flow by frequencies which are different from characteristic frequencies of modes occurring by virtue of the arrangement of the modulatable burners. All the modulated burners have in each case the property that their modulation frequencies are different from the natural instability frequency of the combustion chamber which is determined by the geometric and thermophysical conditions of the combustion chamber.

In a method according to the invention for the reduction of thermoacoustic vibrations in an annular combustion chamber with a plurality of annularly arranged burners, of which a plurality of modulatable burners have means for modulating a fuel mass flow, the number of burners being b0, in a number k of the modulatable burners the fuel mass flow is modulated, these modulated burners being arranged in such a way that between every two modulated burners are arranged in each case a1, a2, . . . ak nonmodulated burners, and the distances between the burners a1+1, a2+1, . . . , ak+1 are not integral divisors of b0.

The method according to the invention makes it possible to bring about a damping of combustion pulsations in a combustion chamber which is equipped with a plurality of modulatable burners. In a preferred variant of the invention, this is carried out, using constant modulation frequencies, so that, when the combustion chamber is in operation, there is no need for any measurement of pulsations and for complicated regulation.

Further preferred embodiments may be gathered from the dependent patent claims.

BRIEF DESCRIPTION OF THE DRAWINGS

The subject of the invention is explained in more detail below with reference to preferred exemplary embodiments illustrated in the accompanying drawings in which.

The reference symbols used in the drawings and the meaning of these symbols are listed together in the list of reference symbols. Identical parts are basically given the same reference symbols in the figures.

DETAILED DESCRIPTION OF THE INVENTION

Figure 1:
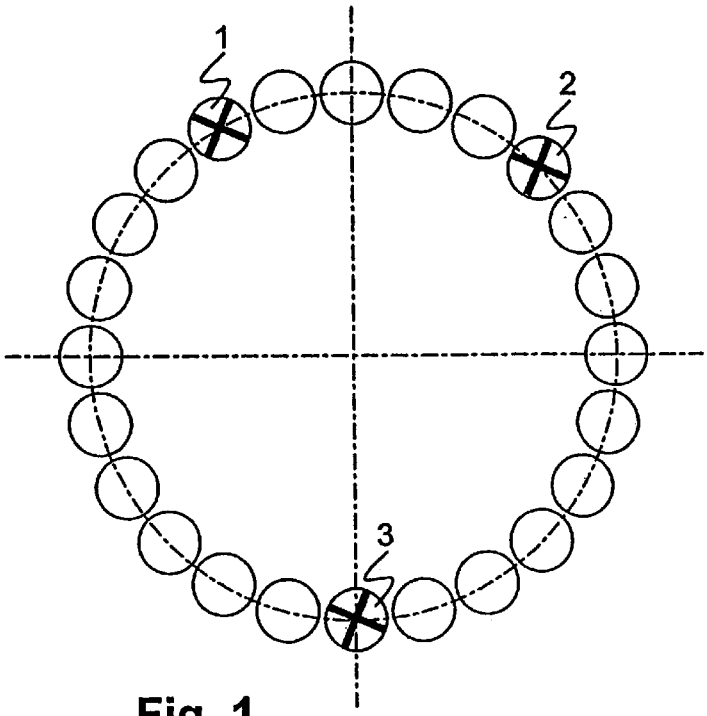
FIG. 1 shows diagrammatically an annular arrangement of burners of an annular combustion chamber with 24 burners according to the invention.

FIG. 1 shows diagrammatically an annular arrangement of burners of an annular combustion chamber with 24 burners. Burners are illustrated diagrammatically by circles, and modulatable burners 1, 2, 3 are illustrated by circles with a cross. The combustion chamber is part of a thermal turbomachine, in particular an industrial gas turbine. The combustion chamber is preferably an annular or else an annular-tube combustion chamber, that is to say its firing space surrounds a rotor of the gas turbine.

What is meant below by a burner or individual burner is a system for the supply of fuel, for introducing the fuel into a working medium, for mixing the fuel with the working medium and, if appropriate, for stabilizing a flame. To fulfill these functions, a burner has, for example, a flame tube, an arrangement for the swirl stabilization of the flame or a fuel lance. In the case of a modulatable burner 1, 2, 3, a means for modulating the fuel mass flow is likewise considered as an integral part of the burner.

A modulatable burner 1, 2, 3 has, for example, a main valve and, as modulation means, a modulation valve connected in parallel with this, said valves supplying the fuel mass flow to the burner. In this case, the main valve is set at a mass flow which is below a nominal mass flow of the burner. An additional mass flow, modulated periodically with an excitation frequency of 0.1 to 1000 Hz, is added by means of the modulation valve, so that the entire mass flow of the burner fluctuates periodically about an average value in the amount of the nominal mass flow. The combustion process in the combustion chamber is thereby excited to periodic fluctuation which is harmless itself, but extracts energy from the periodic pressure fluctuations caused by disturbing combustion fluctuations, so that these pressure fluctuations are damped. In the case of low fuel mass flows, the fuel modulation may also be carried out by means of a single suitable fuel valve for each modulated burner.

The nominal mass flow of the fuel is predetermined by an overriding regulation of the gas turbine which regulates and monitors, for example, the power output, rotational speed and/or temperatures of the gas turbine.

In another embodiment of-the invention, a plurality of burners have a common main valve, and individual modulatable burners 1, 2, 3 have in each case an associated modulation valve for adding a modulated mass flow.

The arrangement according to FIG. 1 has b0=24 burners, of which, in a preferred embodiment of the invention, k=3 burners are modulatable, that is to say a first modulatable burner 1, a second modulatable burner 2 and a third modulatable burner 3.

According to the invention, only some of the burners, preferably less than half or less than a quarter of the burners, are modulatable, and the modulatable burners are arranged in such a way that between each pair of adjacent modulatable burners are arranged in each case a1, a2, . . . ak nonmodulatable burners, and that the values a1+1, a2+1, . . . , ak+1 are not integral divisors of b0. In a preferred embodiment of the invention, a highest value of $$LCM(b0, a1+1), LCM(b0, a2+1), \ldots LCM(b0, ak+1)$$

is maximum, LCM designating the lowest common multiple. The sum a1+a2+. . . +ak+k always amounts to b0.

In the present embodiment, a1=4, a2=8 and a3=9. The lowest common multiples of {b0, a1+1}, {b0, a1+2} and {b0, a3+1} amount, here, to 120, 72 and 120. The highest of these values is therefore 120. Azimuthal acoustic vibrations are always propagated in annular combustion chambers in modes such that one or more pressure nodes are established at those burners which, because of noninfluenceable flow processes, have a flow field suitable for this. The mode which is established is in this case determined by the arrangement of the burners which is usually symmetrical for mechanical engineering reasons. The possible instability frequencies result from the combustion chamber azimuthal, which corresponds to the length of a full wave, or its integral divisors and multiples. A mode, the vibration processes of which run completely over 360° of the combustion chamber azimuthal, is mostly established. According to acoustics physics theory, an azimuthal thermoacoustic vibration in an annular combustion chamber may also be propagated in a mode which causes the pressure vibration to run over more than 360° around the azimuthal of the combustion chamber, until a pressure node has to be re-established. Within the meaning of the invention, the lowest common multiple constitutes, here, a minimum running length, measured in a number of burner diameters, of a pressure vibration established, after which a pressure node can be re-established for the first time. Since long wavelengths, of course, have lower energy, here a lower pressure amplitude, the purpose of the invention, namely the lasting reduction of the pressure fluctuation amplitudes, can be achieved all the more effectively, the higher the lowest common multiple is.

The invention functions as follows: the first modulatable burner is excited with a frequency which is different from a characteristic frequency of an azimuthal vibration of the combustion chamber. As a result, a vibration with this characteristic frequency is damped and damage which would be caused by this vibration is avoided. If only a first modulatable burner 1 is present, this presence signifies an asymmetry of the combustion chamber with otherwise nonmodulated burners. This asymmetry leads, as a rule, to an azimuthal pulsation with a spatial wavelength which is equal to the circumference of the combustion chamber and which has a vibration node at the location of the first modulated burner 1. This vibration is also designated as the (basic) mode of the vibrational system. Higher-frequency modes have additional vibration nodes, and their wavelength is an integral divisor of the combustion chamber azimuthal.

In order to damp the pulsation caused by the first modulatable burner 1, the second modulatable burner 2 is placed according to the invention. It is consequently not located at a node of the basic mode or of one of the first higher-frequency modes. The wavelength of the next mode which is capable of being influenced by the position of the first and second modulatable burner 1, 2 corresponds to twice the distance between the two modulatable burners.

This next mode is damped as a result of the third modulatable burner 3 being placed according to the invention. Remaining modes are damped by the combustion chamber itself, and without any active action, as a function of the exact geometric and physical conditions in the combustion chamber.

The higher the number of modulatable burners, the greater is the risk that, between two modulated burners located near to one another, a high-frequency vibration may be established which may even be superposed on the modulation frequency. This is not azimuthal instability within the meaning of the invention, since the pressure fluctuations, although taking place on the azimuthal, no longer have a completely encircling mode. They then behave rather in the same way as vibrations in two communicating tubes. This situation must be avoided at all costs, since very pronounced pressure fluctuations would be established here. As many modulatable burners as are necessary are therefore used, but as few as possible. Large distances between the modulatable burners are thereby maintained.

In order to damp or completely suppress higher-frequency modes, one or more of the following conditions must be satisfied:

1. None of the values {a1+1,a2+1, . . . ,ak+1} is an integral divisor of b0.
2. A highest value of $$LCM(b0, a1+1), LCM(b0, a2+1), \ldots LCM(b0, ak+1)$$

is maximum.

3. At least three of any number of annularly arranged burners are modulatable burners.
4. None of the number a1, a2, . . . ak are equal, that is to say "i,j:ai[1]aj, unless the foregoing conditions cannot otherwise be satisfied. The effect of this condition is also that, normally, there is no axis in relation to which the arrangement of modulatable burners is mirror-symmetrical. If this is unavoidable, the modulation frequency of the middle burner must be selected such that it is not an integral divisor and also not an integral multiple of the natural instability frequency between the burners.
5. The arrangement of the modulatable burners 1, 2, 3, . . . , k maximizes a lowest common multiple of {b0, a1+1, a2+1, . . . ak+1, a1+a2+2, a2+a3+2, . . . ak+a1+2}. This condition means that distances between modulatable burners which are not adjacent but between which exactly one modulatable burner is located are also taken into account.

Values of the parameters k, a1, a2, . . . ak which satisfy one or more of the required conditions are determined heuristically or by means of nonlinear or stochastic optimization methods. In a variant which is simple to implement, but is arithmetically complicated, values of the parameters for a given b0 are produced by the systematic generation of all possible value combinations and by checking the conditions. For example, a value of k is selected, k preferably being 3 or being between 2 and 5. Then, for this k, all the value combinations of a1, a2, . . . ak for which the sum is $$a1+a2+\ldots+ak+k=b0$$

are systematically selected. This step is repeated for different values of k. The conditions are checked preferably by first checking the first condition according to the above list. If a plurality of value combinations satisfy the first condition, those of these value combinations which also satisfy the second condition are selected. If a plurality of value combinations also satisfy the second condition, those of these value combinations which also satisfy the third condition are selected. The method is continued in a similar way until only a value combination which is thus optimal is left and/or all the conditions are taken into account. In a variant of the invention, a check is made as to whether the third condition is satisfied before whether the second condition is satisfied.

Excitation frequencies for the modulatable burners 1, 2, 3 are preferably selected differently and in such a way that they do not excite any of the existing vibration modes. Excitation frequencies are therefore different from characteristic frequencies of modes which occur by virtue of the arrangement of the modulated burners. Typical frequencies of azimuthal thermoacoustic combustion instabilities lie around approximately 50–80 Hz in present annular combustion chambers. The modulation frequency selected may be markedly lower and should be around 20–30 Hz for the example mentioned. Practical experience shows that about 5% of the fuel mass flow has to be modulated in order to suppress an instability effectively.

The excitation frequencies are determined, for example, on the basis of calculations or of measurements of characteristic frequencies during commissioning of the turbine. In a preferred embodiment of the invention, these excitation frequencies, which are determined once, are assigned to the modulatable burners 1, 2, 3. When a gas turbine is in operation, each of the modulatable burners 1, 2, 3 is excited with the respective excitation frequency in an open-loop or unregulated operating mode. There is no need for any measurement of pulsations and/or for special regulation to activate the modulatable burners 1, 2, 3 on the basis of measurements.

Figure 2:
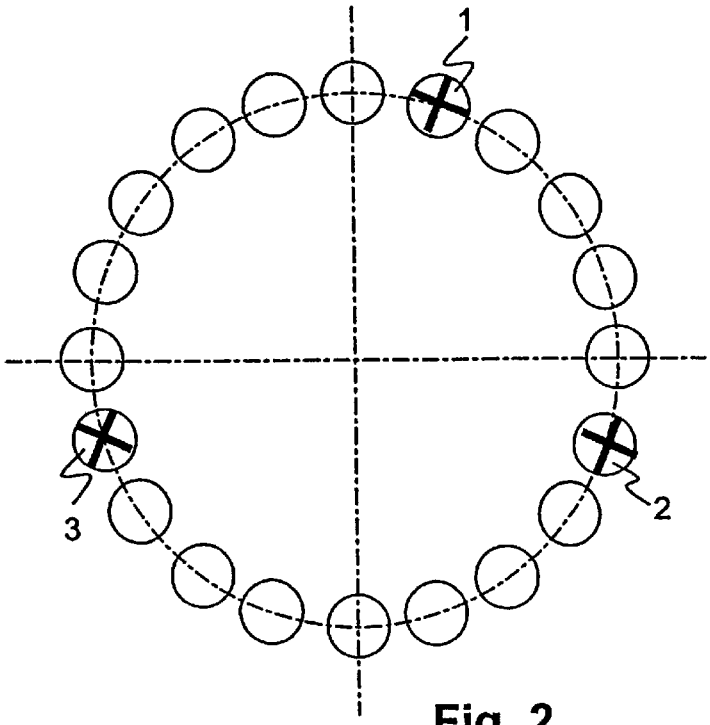
FIG. 2 shows diagrammatically an annular arrangement of burners of an annular combustion chamber with 20 burners according to the invention.

FIG. 2 shows diagrammatically an annular arrangement of burners of an annular combustion chamber with 20 burners. In this, a1=4, a2=7 and a3=6.

Figure 3:
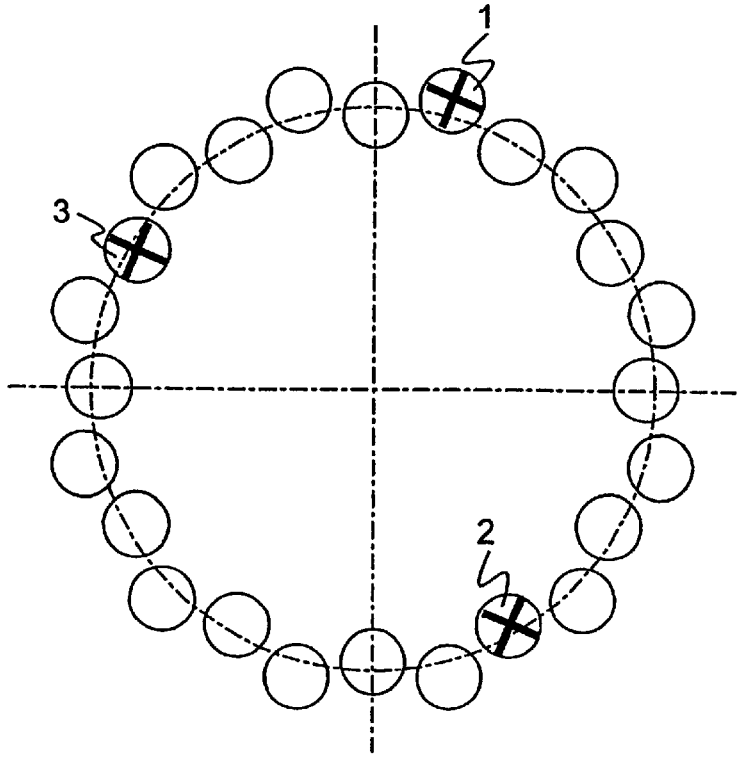
FIG. 3 shows diagrammatically an annular arrangement of burners of an annular combustion chamber according to the invention, burners being offset relative to one another in the radial direction.
Figure 4:
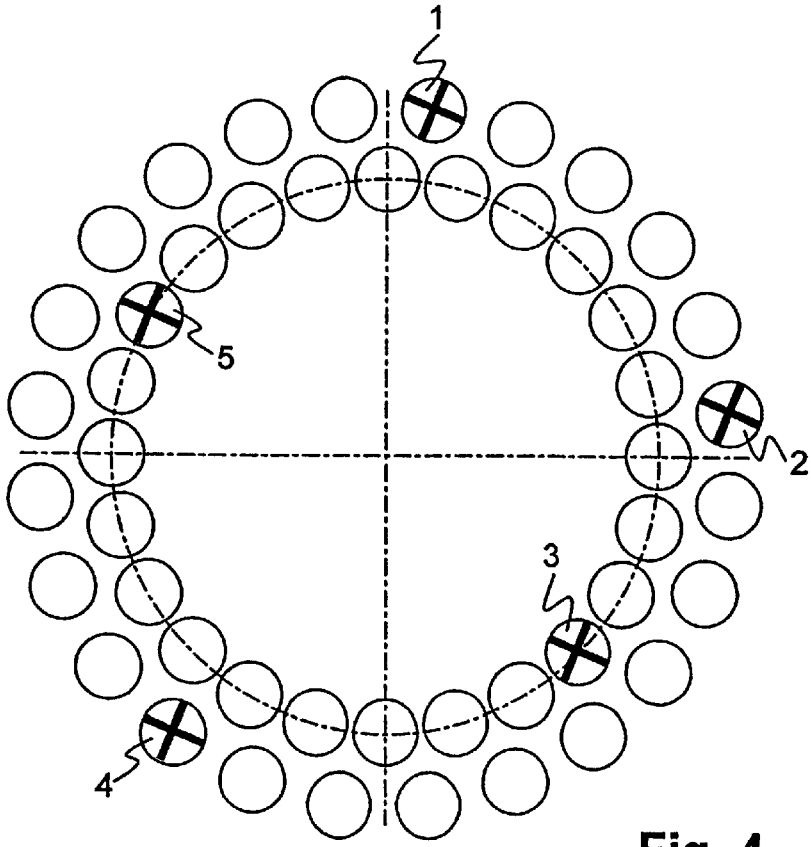
FIG. 4 shows diagrammatically an arrangement of burners of an annular combustion chamber according to the invention which form two concentric annular arrangements.

FIG. 3 shows diagrammatically an annular arrangement of burners of an annular combustion chamber, burners being offset relative to one another in the radial direction. As long as this radial offset is relatively small, the arrangement is treated in the same way as an arrangement without any offset and modulatable burners 1, 2, 3 are arranged as described above. If the radial offset is greater, the arrangement may be considered as two concentric annular arrangements of burners, as shown in FIG. 4. In this embodiment of the invention, distances between modulatable burners 1, 2, 3, 4, 5 are determined individually for each of the two concentric arrangements. In a preferred embodiment of the invention, the two concentric arrangements have at least approximately the same distances between modulatable burners 1, 2, 3, 4, 5, the arrangements being rotated relative to one another. In this configuration, however, it must be remembered that combustion pulsations may also arise between the burners of the inner and of the outer circle and therefore the above-mentioned rules must also apply here. Here, however, the multiplicity of installed burners drastically reduces the number of possible combinations in which all the conditions can be satisfied. In most cases, this is not possible. In these cases, the preferred frequency of the mode, the half wavelength of which corresponds to the distance between any two burners, must be determined by the distances between the modulatable burners and the basic frequency of the combustion chamber. This preferred frequency and its integral multiples or integral divisors is to be avoided without fail in the selection of the modulation frequency.

The method according to the invention for the reduction of thermoacoustic vibrations is carried out in a combustion chamber with a plurality of annularly arranged burners, of which a plurality of modulatable burners have means for modulating a fuel mass flow. Of the plurality of modulatable burners, individual ones, but not necessarily all, are modulated according to the invention. A distinction is therefore made between modulatable burners and burners actually modulated according to the invention. According to the invention, the fuel mass flow is modulated periodically in a number k of the modulatable burners, these modulated burners being arranged in such a way that between every two modulated burners are arranged in each case a1, a2,. . . ak nonmodulated burners, and a lowest common multiple of {b0, a1+1, a2+1, . . . ak+1} being in each case maximum.

When a distance an+1 is an integral divisor of b0, an azimuthal vibration mode is then built up with a high degree of probability. If this is unavoidable, the vibration is suppressed by an appropriate selection of the modulation frequency.

The advantage of the method according to the invention is that, for example in a gas turbine which is equipped with modulatable burners for the control of axial and/or helical combustion instabilities or for temperature regulation, azimuthal vibrations can also be damped in a simple way. The modulation frequencies for controlling the different instabilities lie in similar frequency ranges, but are different for each individual case. It is advantageous, at the same time, if the fuel/air supply-combustion-combustion chamber system is lastingly detuned acoustically by the selection of frequencies which differ to the greatest possible extent.

List of Reference Symbols

1 First modulatable burner
2 Second modulatable burner
3 Third modulatable burner
4 Fourth modulatable burner
5 Fifth modulatable burner

What is claimed is:

1. A combustion chamber with a plurality of annularly arranged burners, of which a plurality of modulatable burners have means for modulating a fuel mass flow, the number of burners being b0 and the number of modulatable burners being k, wherein k<b0, and the modulatable burners are arranged in such a way that between every two modulatable burners are arranged in each case a1, a2,. . . ak nonmodulatable burners, and in that the values a1+1, a2+1, . . . , ak+1 are not integral divisors of b0.

2. The combustion chamber as claimed in claim 1, wherein a highest value $$LCM(b0, a1+1), LCM(b0, a2+1), \ldots LCM(b0, ak+1)$$

is maximum, LCM designating the lowest common multiple.

3. The combustion chamber as claimed in claim 1, wherein at least three of the burners are modulatable burners.

4. The combustion chamber as claimed in claim 1, wherein a1, a2, . . . ak are different from one another.

5. The combustion chamber as claimed in claim 1, wherein a highest value of $$LCM(b0, a1+1), LCM(b0, a2+1), \ldots LCM(b0, ak+1),$$

$$LCM(b0, a1+a2+2), LCM(b0, a2+a3+2), \ldots LCM(b0, ak+a1+2)$$

is maximum.

6. The combustion chamber as claimed in claim 1, wherein, in order to modulate their fuel mass flow, the modulated burners are designed with frequencies which are different from characteristic frequencies of modes which occur by virtue of the arrangement of the modulated burners.

7. The combustion chamber as claimed in claim 1, wherein b0=24, k=3, a1=4, a2=9and a3=10.

8. The combustion chamber as claimed in claim 1, wherein b0=20, k=3, a1=5, a2=8 and a3=7.

9. A method for the reduction of thermoacoustic vibrations in a combustion chamber with a plurality of annularly arranged burners, of which a plurality of modulatable burners have means for modulating a fuel mass flow, the number of burners being b0, wherein the fuel mass flow is modulated in a number k of the modulatable burners, these modulated burners being arranged in such a way that between every two modulated burners are arranged in each case a1, a2 . . . . ak nonmodulated burners, and wherein the values a1+1, a2+1, . . . , ak+1 are not integral divisors of b0.

10. The method as claimed in claim 9, wherein a highest value of $$LCM(b0, a1+1), LCM(b0, a2+1), \ldots LCM(b0, ak+1)$$

is maximum, LCM designating the lowest common multiple.

* * * * *